US008534342B2

(12) United States Patent
Grossman

(10) Patent No.: US 8,534,342 B2
(45) Date of Patent: Sep. 17, 2013

(54) RETRACTABLE ARCUATE WINDOW COVERING

(76) Inventor: Jeffrey Paul Grossman, Huntington, NY (US)

( * ) Notice: Subject to any disclaimer, the term of this patent is extended or adjusted under 35 U.S.C. 154(b) by 48 days.

(21) Appl. No.: 12/912,222

(22) Filed: Oct. 26, 2010

(65) Prior Publication Data

US 2011/0094688 A1 Apr. 28, 2011

Related U.S. Application Data

(60) Provisional application No. 61/255,075, filed on Oct. 26, 2009.

(51) Int. Cl.
*A47H 23/02* (2006.01)

(52) U.S. Cl.
USPC ..... 160/84.07; 160/126

(58) Field of Classification Search
USPC ..... 160/84.07, 134, 348, 84.04, 84.01, 160/126, 344, 345, 84.03, 84.06, 124; 472/77, 472/78, 79
See application file for complete search history.

(56) References Cited

U.S. PATENT DOCUMENTS

| | | | | | |
|---|---|---|---|---|---|
| 190,348 | A | | 5/1877 | May | |
| 602,967 | A | | 4/1898 | Wells | |
| 1,447,189 | A | | 3/1923 | Simon | |
| 1,549,535 | A | * | 8/1925 | Gray | 160/126 |
| 1,609,877 | A | | 12/1926 | Kendall | |
| 1,707,101 | A | | 3/1929 | Taylor | |
| 1,756,043 | A | * | 4/1930 | Weidhaas | 160/340 |
| 2,234,804 | A | | 3/1941 | Murray | |
| 2,627,918 | A | * | 2/1953 | Gordon | 160/348 |
| 2,671,508 | A | * | 3/1954 | Gordon | 160/348 |
| 3,082,818 | A | * | 3/1963 | Judovits | 160/344 |
| 4,518,025 | A | * | 5/1985 | Judkins | 160/84.04 |
| 4,699,195 | A | | 10/1987 | Lester | |
| 4,776,380 | A | | 10/1988 | Lester | |
| 4,825,611 | A | * | 5/1989 | Bassett | 52/222 |
| 4,860,492 | A | | 8/1989 | Roy | |
| 4,861,090 | A | | 8/1989 | Gavrieli | |
| 4,934,434 | A | | 6/1990 | Schnebly et al. | |
| 4,934,436 | A | | 6/1990 | Schnebly | |
| 5,002,112 | A | | 3/1991 | Schnebly et al. | |
| 5,010,939 | A | | 4/1991 | King | |
| 5,044,418 | A | | 9/1991 | Donahue | |
| 5,050,661 | A | | 9/1991 | Sikkema et al. | |
| 5,063,985 | A | | 11/1991 | Bozzo | |

(Continued)

*Primary Examiner* — David Purol
(74) *Attorney, Agent, or Firm* — Hoffmann & Baron, LLP

(57) ABSTRACT

A retractable covering for an arched window including a first and a second panel formed of pliable material. A flap of the first panel overlaps a flap of the second panel. The first and second panels together have a generally arch-shaped upper perimeter adapted to be secured to a support structure and have a generally straight lower perimeter. A retracting mechanism moves the first and second panels between a closed position wherein the arched window is substantially covered and an open position wherein the arched window is substantially uncovered. The retracting mechanism includes a first cord secured to the first panel flap, and a second cord secured to the second panel flap. The retracting mechanism having a first operating state to position the first and second panels in the open position and a second operating state wherein the first and second panels are positioned in the closed. The retracting mechanism further includes a cord guide through which at least a portion of the first and second cords extend. The cord guide guides the first and second cords along the arched perimeter of the first and second panels.

17 Claims, 4 Drawing Sheets

(56) References Cited

U.S. PATENT DOCUMENTS

| | | | | |
|---|---|---|---|---|
| 5,117,889 | A | 6/1992 | Coe | |
| 5,139,070 | A | 8/1992 | Kidd | |
| 5,159,966 | A | 11/1992 | Fleishman et al. | |
| 5,168,912 | A | 12/1992 | Jelic et al. | |
| 5,183,092 | A | 2/1993 | Jelic | |
| 5,207,257 | A | 5/1993 | Rupel et al. | |
| 5,219,407 | A * | 6/1993 | Herring | 160/330 |
| 5,341,864 | A | 8/1994 | Rupel et al. | |
| D360,552 | S | 7/1995 | Lopez | |
| 5,471,789 | A | 12/1995 | Faircloth | |
| 5,537,780 | A | 7/1996 | Cleaver et al. | |
| 5,564,229 | A | 10/1996 | Noska | |
| 5,584,329 | A | 12/1996 | Thomas | |
| 5,598,883 | A | 2/1997 | Platsis | |
| 5,632,316 | A | 5/1997 | Cohen | |
| 5,660,220 | A | 8/1997 | Ruan | |
| 5,662,153 | A | 9/1997 | Rosenblatt | |
| 5,713,156 | A | 2/1998 | Briggs, Sr. | |
| 5,765,619 | A * | 6/1998 | Arnold | 160/84.07 |
| 5,794,680 | A | 8/1998 | Xue | |
| 5,823,241 | A | 10/1998 | Sitzes et al. | |
| 6,029,733 | A | 2/2000 | Xue | |
| 6,062,291 | A | 5/2000 | Morgan et al. | |
| 6,145,569 | A | 11/2000 | Shaw et al. | |
| 6,192,967 | B1 | 2/2001 | Huang | |
| 6,257,301 | B1 | 7/2001 | Conforti | |
| 6,341,447 | B1 | 1/2002 | Jean | |
| 6,390,172 | B1 | 5/2002 | Fleishman et al. | |
| 6,478,071 | B1 | 11/2002 | Workman et al. | |
| 6,651,722 | B1 | 11/2003 | Fleishman et al. | |
| 6,820,674 | B2 | 11/2004 | Abita et al. | |
| 7,086,447 | B2 | 8/2006 | Garman | |
| 7,188,658 | B1 | 3/2007 | Nordstrom et al. | |
| 7,302,985 | B2 | 12/2007 | Larsen | |
| 7,383,870 | B2 | 6/2008 | Larsen | |
| 7,650,922 | B2 | 1/2010 | Alberti | |
| 7,721,782 | B2 | 5/2010 | Foley et al. | |
| 2004/0112548 | A1 | 6/2004 | Militello et al. | |
| 2005/0126716 | A1 | 6/2005 | Militello et al. | |
| 2006/0196614 | A1 * | 9/2006 | Strand et al. | 160/124 |
| 2007/0227678 | A1 * | 10/2007 | Buechin | 160/348 |
| 2008/0072507 | A1 | 3/2008 | Chuang et al. | |
| 2008/0093031 | A1 | 4/2008 | Alberti | |
| 2008/0135188 | A1 | 6/2008 | DeBauche | |
| 2010/0193142 | A1 | 8/2010 | Pflieger | |

* cited by examiner

RETRACTABLE ARCUATE WINDOW COVERING

This application claims the benefit of priority to U.S. Provisional Patent Application Ser. No. 61/255,075 filed on Oct. 26, 2009, which is incorporated by reference herein in its entirety for all purposes.

FIELD OF THE INVENTION

The present invention relates to a window covering for an arched window, and more particularly, to a window covering for an arched window which is retractable.

BACKGROUND OF THE INVENTION

Window coverings, also referred to as window treatments, are typically employed in homes and buildings to regulate the amount of light passing through a window and to provide a degree of privacy. Such window coverings may be in the form of curtains, drapes, blinds or shades. Window covering used on rectangularly-shaped windows are typically retractable to some degree to selectively expose or cover the window. The window covering may be mounted above the window and moved up and down by way of a cord or spring-loaded roller.

Semi-circular or arch-shaped windows present unique challenges for retractable window coverings. Various designs to cover arch-shaped windows with retractable coverings have been attempted. For example, U.S. Pat. Nos. 7,650,922, 5,662,153, and 5,050,661 disclose window shades that can be opened and closed. However, in each of these devices, the shade includes panels arranged in a fan-like configuration so that the panels are moved to one or both sides to open the shade. This creates a window covering with a series of radially extending lines which may not be desirable. In addition, the shade may include a number of segmented slats or panels that are intricately formed and joined together adding to the difficulty and expense of manufacturing. The segmented slats form an interrupted and unsmooth surface.

A further attempt to cover an arch-shaped window with a retractable shade is disclosed in U.S. Pat. No. 6,478,071. In this patent a multi-segmented header is attached to a shade. As the header is pulled up with a cord, the header segments move to form an arch-shape member. This design requires a number of elements which would be complex and costly to manufacture.

The solutions of the prior art are not suitable for flat roman-type shades which have substantially flat appearance when closed. A roman shade is a tailored, fabric window shade that hangs as a flat panel and is raised by cords to fold accordion-style. The prior art fails to provide a suitable solution for an arched window that both retracts and matches the aesthetic of flat roman shades.

Accordingly, it would be desirable to provide a window covering for arched windows which is aesthetically pleasing and can be retracted to selectively cover and uncover the window.

SUMMARY OF INVENTION

The present invention provides a retractable window covering for an arcuate window.

The present invention also provides a retractable covering for an arched window including a first and a second panel formed of pliable material. A flap of the first panel overlaps a flap of the second panel. The first and second panels together have a generally arch-shaped upper perimeter adapted to be secured to a support structure and a have a generally straight lower perimeter. A retracting mechanism moves the first and second panels between a closed position wherein the arched window is substantially covered and an open position wherein the arched window is substantially uncovered. The retracting mechanism includes a first cord secured to the first panel flap, and a second cord secured to the second panel flap. The retracting mechanism having a first operating state to position the first and second panels in the open position and a second operating state wherein the first and second panels are positioned in the closed. The retracting mechanism further includes a cord guide through which at least a portion of the first and second cords extend. The cord guide guides the first and second cords along the arched perimeter of the first and second panels.

The present invention further provides a retractable covering for an arched window including an arch-shaped support structure adapted to be secured to a window frame. A first and a second panel is formed of pliable material. A flap of the first panel overlaps a flap of the second panel. The first and second panels together have a generally arch-shaped upper perimeter secured to the support structure and a generally straight lower perimeter. The first and second panels have a closed position wherein the arched window is substantially covered, and have an open position wherein the arched window is substantially uncovered. A retracting mechanism moves the first and second panels between the open and closed position. The retracting mechanism includes a first cord secured to the first panel flap, and a second cord secured to the second panel flap. The retracting mechanism has a first operating state to position the first and second panels in the open position and a second operating state wherein the first and second panels are in the closed position. The retracting mechanism further includes a cord guide through which at least a portion of the first and second cords extend. The cord guide guides the first and second cords along the arched perimeter of the first and second panels.

The present invention still further provides a retractable covering for a window including a support structure having a generally arch-shaped configuration adapted to be secured about at least a portion of a perimeter of the window. A first and a second panel formed of pliable material are fixedly secured to the frame in an overlapping manner. The first and second panels have a closed position wherein the window is substantially covered, and have an open position wherein the window is substantially uncovered. A retracting mechanism moves the first and second panels between the open and closed position. The retracting mechanism extends along at least a portion of the support structure in a guided manner and being operably secured to the first and second panels. The retracting mechanism lifts the first and second panels from the closed position in a direction toward the support structure and to the open position to expose the window.

DETAILED DESCRIPTION OF THE PREFERRED EMBODIMENTS

Figure 1:
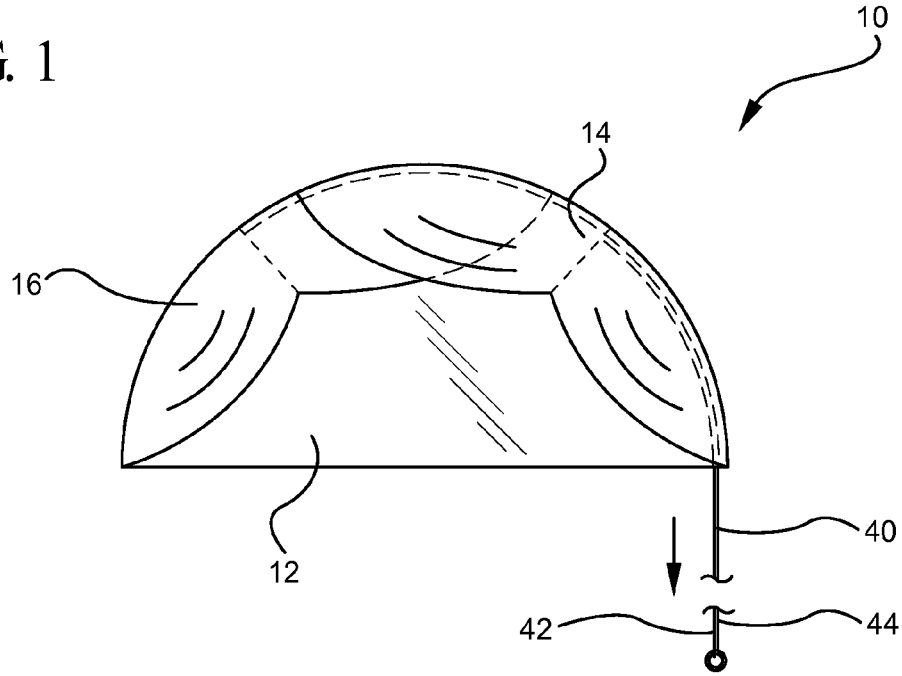
FIG. 1 is a front elevational view of a window covering shown in the open position.

With reference to FIGS. 1-5, a retractable window covering 10 for an arcuate window 12 is shown. The window 12 to be covered may have a generally semicircular shape and may be positioned within a home or building by its self, or it may be disposed atop a rectangular window. The retractable window covering 10 includes a first panel 14 and a second panel 16 formed of a pliable material. This material may include a fabric of the type which is commonly used to make window coverings, and in particular, roman shade style window coverings. The material may be of a type which hangs generally flat providing a smooth, planar covering surface. The window covering 10 may be in the form of a shade, drape, curtain or other window coverings or treatments. The first and second panels 14 and 16 may include overlapping flaps 30 and 32 respectively.

Figure 3A:
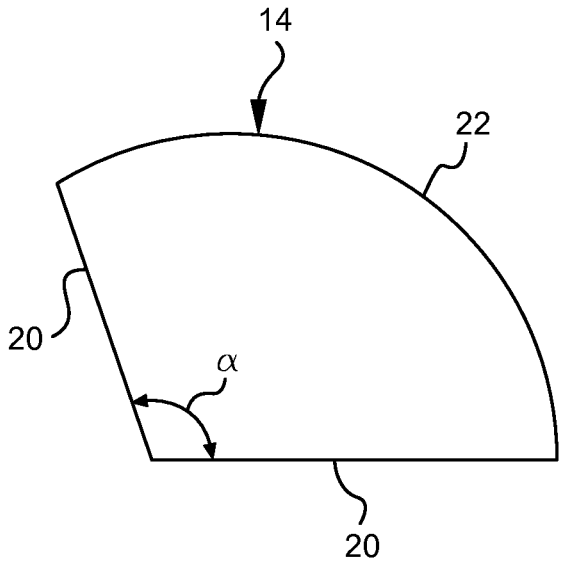
FIG. 3A is a front elevational view of a first window covering panel.

With reference to FIG. 3A, the first panel 14 may include first and second intersecting side 20 which are generally straight. The angle $\alpha$ formed by the first and second side is preferably greater than 90 degrees. The first and second sides 20 may be joined by an arcuate side 22 which forms an upper perimeter of the first panel.

Figure 3B:
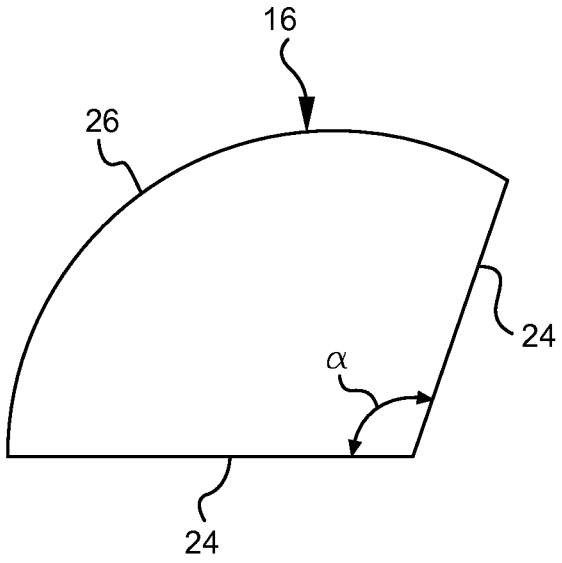
FIG. 3B is a front elevational view of a second window covering panel.

With reference to FIG. 3B, the second panel 16 may be formed similarly to the first panel by the mirror image thereof. Accordingly, the second panel may include first and second substantially straight sides 24 which are joined by an arcuate side 26 joining the ends of the straight sides. The angle $\alpha$ formed by the first and second sides is preferably greater than 90 degrees.

Figure 2:
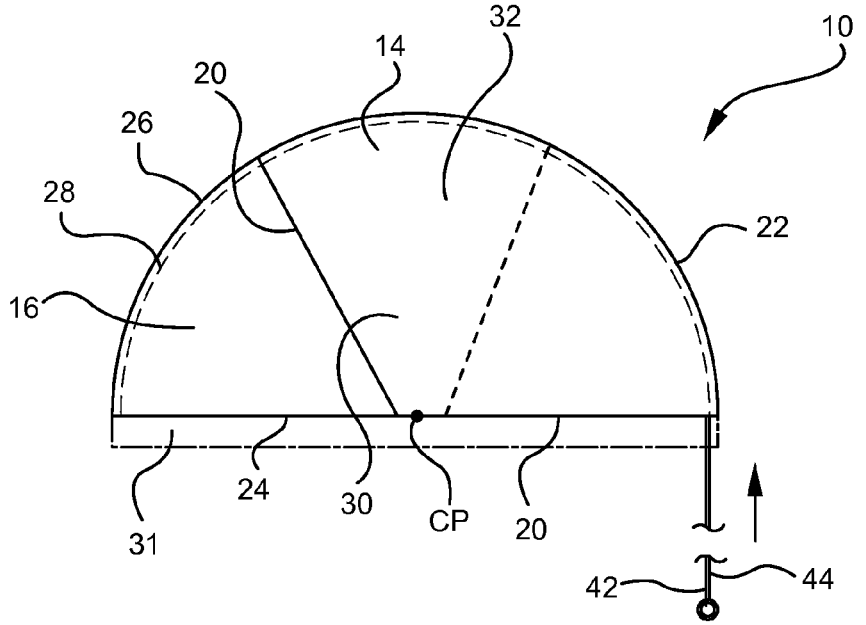
FIG. 2 is a front elevational view of the window covering shown in the closed position.
Figure 4:
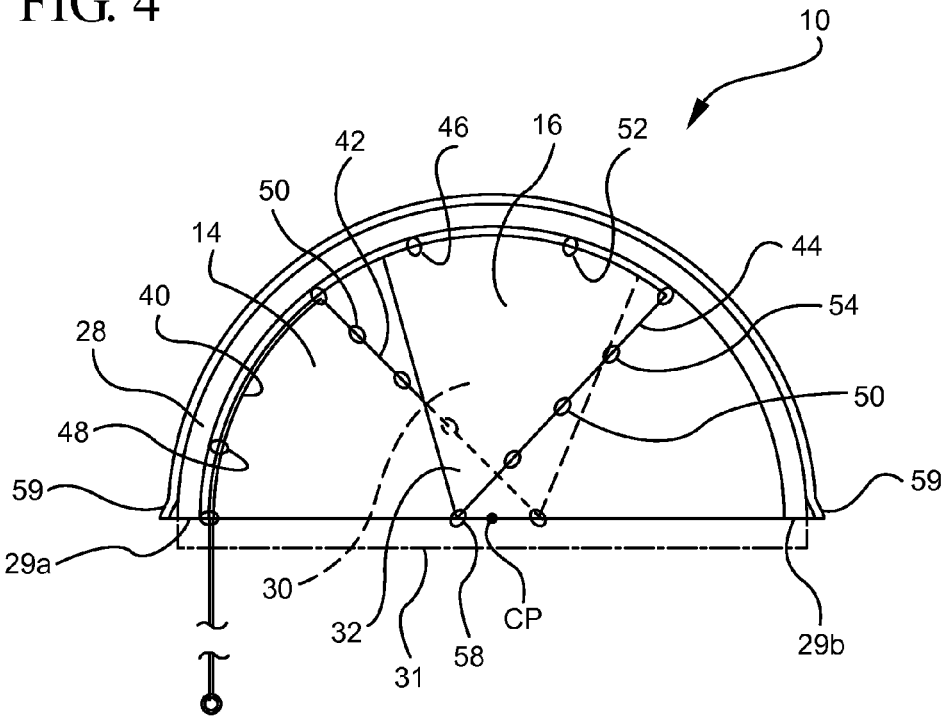
FIG. 4 is a rear elevational view of the window covering shown in the closed position and a retracting mechanism.
Figure 6:
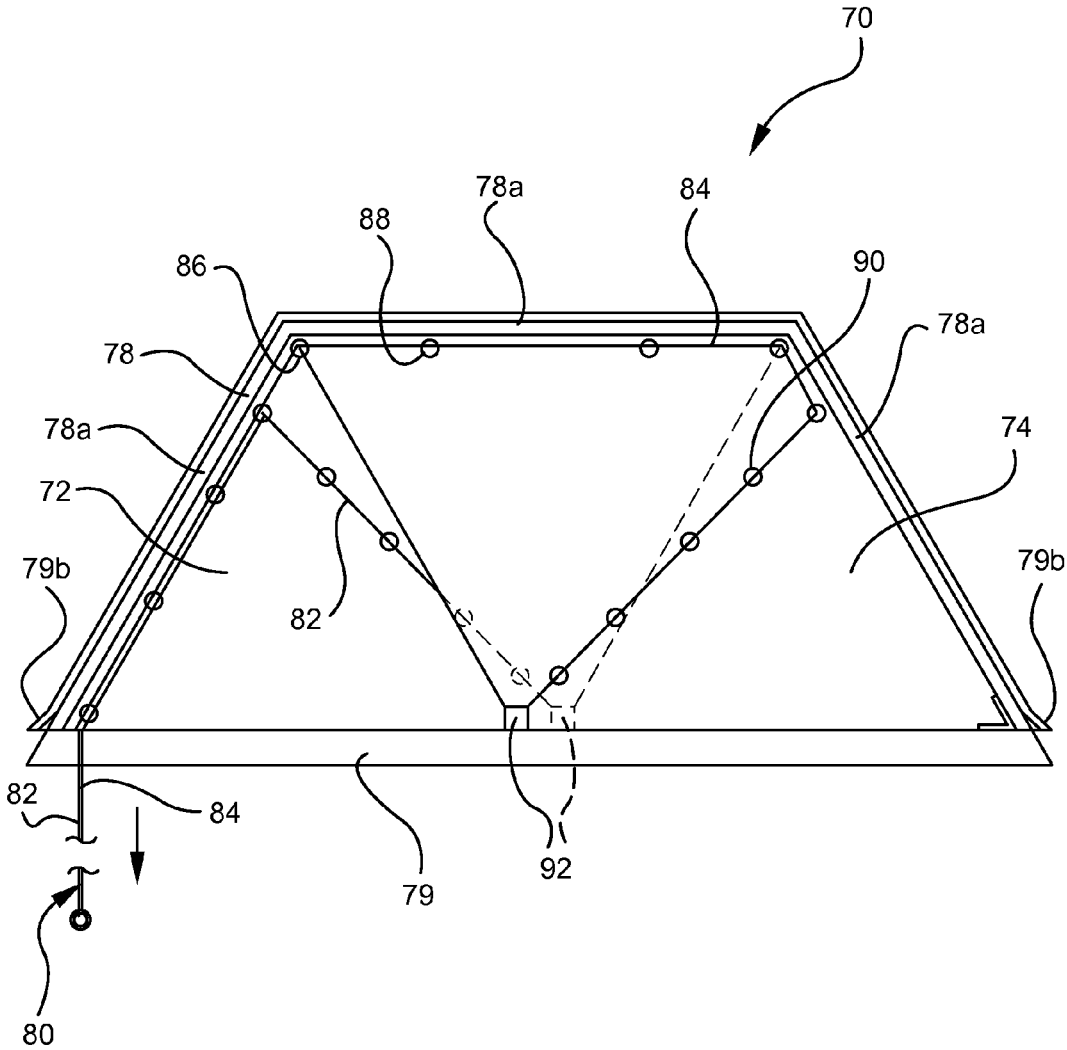
FIG. 6 is a rear elevational view of the window covering shown in the closed position and a retracting mechanism, where the widow is the shape of a trapezoid.

With further reference to FIGS. 2 and 4, the first and second panels 14 and 16 may be secured to a support structure 28 such as a frame having an arcuate configuration. In this embodiment, the arcuate frame 28 may be formed of a continuously curved member (FIG. 4). In an alternative embodiment described below, the frame may be formed of a plurality of linear segments 78*a* joined together (FIG. 6). The frame may be secured at opposite ends 29*a* and 29*b* to a base 31 to help maintain the frame in an arch shape. The frame may define an arcuate opening which coincides with the shape of the window 12. The arcuate sides 22 and 26 of the first and second panels may be secured to the frame 28 by gluing, stapling, nailing or any other means for securing pliable material to a rigid structure as known in the art.

The frame 28 may be secured to a wall or trim surrounding the arched window 12 and the shape of the frame may be formed to approximate the curvature of the window. In this embodiment, the ends 29*a* and 29*b* of the arched portion of the frame would be secured directly to the window or window trim. In an alternative embodiment, the ends of the arched frame may be secured to the base 31 having a generally straight and planar configuration as shown in FIG. 4. The base 31 provides rigidity to the arch portion of the frame. In order to install the window covering, the base 31 and frame 28 may be secured to a window or surrounding structure by fasteners, brackets or other devices known in the art. Alternatively, the support structure may include the trim or a portion of the wall surrounding the window 12. In this case, the fabric could be secured directly to the trim or window frame or wall which has an arched configuration.

The first panel 14 when installed on the frame 28 is in the shape of the arched window with a straight cut that runs from a point on the arcuate frame roughly ⅔ of the way from right to left along the arcuate frame, to a point on the base 31 slightly to the left of the center point, CP. The second panel 16 when installed on the frame is a mirror image of the first panel and in the shape of the arched window with a straight cut that runs from a point on the arcuate frame roughly ⅔ of the way from left to right along the arch, to a point on the base 31 slightly to the right of a center point, CP.

The first and second panels 14 and 16 may be secured to the frame 28 such that flap 30 on the first panel overlaps flap 32 of the second panel. Accordingly, when the first and second panels are in the closed position as shown in FIG. 2, they substantially cover window 12 to which the window covering 10 is applied. When the first and second panels 14 and 16 are secured to the support structure 28, a portion of the outer panel (or first panel 14) is visible on the outer surface of the window covering, as shown in FIG. 2.

The window covering 10 may further include a retracting mechanism 40 for moving the first and second panels 14 and 16. The retracting mechanism may have a first operating state wherein the first and second panels 14 and 16 are in a closed position such that the arched window is substantially covered (FIG. 2) and a second operating state wherein the first and second panels 14 and 16 are in an open position such that the arched window is substantially uncovered (FIG. 1). With reference to FIG. 4, the retracting mechanism 40 may include a first cord 42 secured to the first panel flap 30 and the second cord 44 secured to a second panel flap 32. A cord guide 46 is provided in order to direct the position of the first and second cords. The cord guide 46 includes a first portion 48 which is secured to the frame 28 and guides the path of the first and second cords along the arcuate frame. The cord guide 46 further includes a second portion 50 which guides the direction of the first and second cords as they travel along a portion of the first and second panels. The cord guide first portion 48 may include a series of eye hooks 52 secured to the frame 28 and cord guide second portion 50 may include a plurality of loops 54 sewn into the back of the first and second panel. The hooks 52 and loops 54 allow the cords to extend therethrough and slide there within. While eye hooks and loops are shown herein, it is within the contemplation of the present invention that other structures which allow a cord to pass there-through may be employed as cord guide 46. Accordingly, the cord guide allows the first and second cords 42 and 44 to move in a guided manner. By guiding the path of the cords, the first and second panels 14 and 16 may be retracted in a manner that permits a substantial portion of the window to be exposed.

Figure 5:
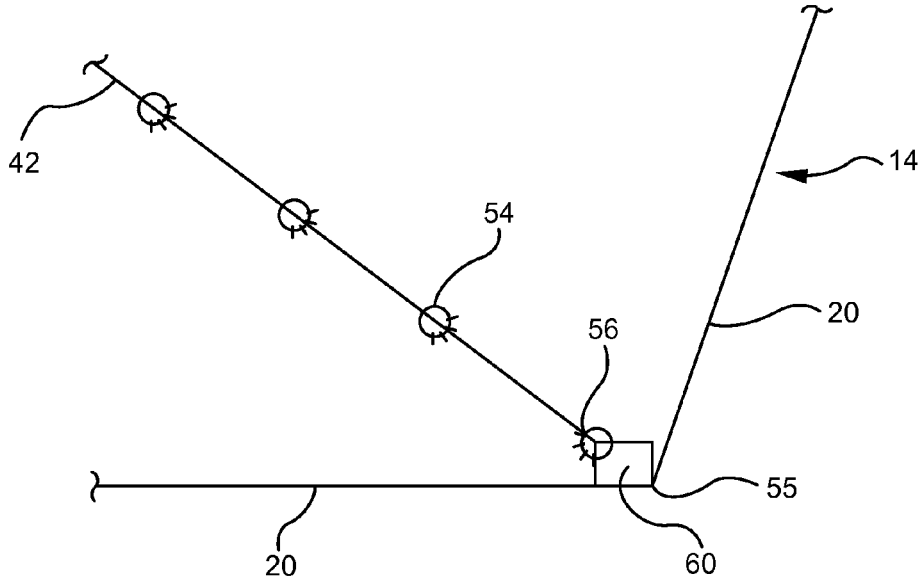
FIG. 5 is a detail elevational view of a window panel and retracting mechanism.

As shown in FIGS. 4 and 5, the first cord 42 extends through a series of spaced eye hooks 52 secured to the frame 28 such that the first cord travels in a generally arcuate path along the arcuate frame 28. At a point approximately ⅓ along the frame from end 29*a*, the first cord 42 then extends from the frame and the arcuate perimeter 22 of the first panel in a generally radial direction along the inside of the first panel toward the corner 55 in which the first panel first and second sides 20 intersect. As the first cord 42 extends across the first panel it is guided by the loops 54 which form the cord guide second portion 50. Adjacent this intersection, the first cord end 56 is fixedly secured to the first panel 14. Accordingly, when the first cord 42 is moved downwardly in an opening direction, as indicated by the arrow in FIG. 1, the corner 55 of the first panel will be drawn in a generally radial direction toward the curved perimeter of the first panel and likewise towards the support structure. This movement of the first cord 42 has a vertical component which pulls the first panel 14 upwardly and a horizontal component which pulls the first panel away from the second panel 16. Since the first panel material is pliable, it will tend to fold as the first cord 42 is moved in the opening direction.

As shown in FIG. 4, the second cord 44 extends further along the arcuate perimeter of the support structure to a point approximately ⅓ of the way from the second end of the frame 29*b*. The second cord 44 then extends from the frame in a generally radial direction along the back of the second panel 16 through cord guide loops 54 until it terminates at a corner 58 formed at the intersection between the second panel first and second sides 24. The second cord 44 is fixedly secured to the second panel adjacent the corner 58. When the second cord 44 is pulled in the open direction indicated by the arrow in FIG. 1, the corner 58 is drawn in a generally radial direction toward the curved perimeter of the second panel. This movement of the second cord 44 has a vertical component which pulls the second panel 16 upwardly and a horizontal component which pulls the first panel away from the first panel 14. The second panel 16 being formed of a pliable material will tend to fold as the second cord is operated on.

Accordingly, with the first and second cords 42 and 44 moved to an open position, the first and second panels 14 and 16 move upwardly toward the frame and away from each other and assume an open position wherein the window would be substantially uncovered. As shown in FIG. 1, in the open state, the folded first and second panels 14 and 16 form essentially three bunches of material that provide an aesthetically pleasing appearance.

The retracting mechanism 40 is preferably disposed on a back side of the window covering such that it is not visible to one viewing the front of the window. The only portion that may be visible are the first and second cords 42 and 44 which would hang below the window 12 in order to provide axis for a user to operate the retracting mechanism.

The outer arcuate perimeter of the first and second panels 22 and 26, which are fixedly secured to the arcuate frame 28, may include an unattached portion 59 adjacent the first and second frame ends 29*a* and 29*b* wherein the panel material in not fixedly secured thereto. This improves the extent to which the first and second panels can be raised by allowing the first and second panels to be moved fully into the open position and create a larger opening, thereby exposing more of the window. Alternatively, near the base of the arcuate frame, the first and second panels can be attached to a wire guide (not shown) via eyehooks, to allow the bottom corners of the panels to be pulled up slightly along the arch when the shades are raised.

In order to close the window covering 10 the retracting mechanism 40 may be moved to the second operating state wherein the first and second panels 14 and 16 are positioned in a closed position substantially covering the window 12. In order to assume this second or closed position, the first and second cords are released and gravity pulls the first and second panels 14 and 16 back down to their flat resting positions as shown in FIG. 2. In this closed position, the flaps 30 and 32 of the first and second panel overlap, thereby covering the window 12. Depending on the type of fabric and the amount of friction along the first and second cords, it may be desirable to attach weights 60 into the bottom of the panels to assist in moving the panels back into the closed position. The weight 60 may be secured to the first and second panels adjacent the intersection between the first and second substantially straight sides, as shown for example in FIG. 5. It is also within the contemplation of the present invention that additional weights may be attached along the bottom edges of the first and second panels to improve their ability to assume the closed position under the influence of gravity.

In one embodiment, the first and second cords 42 and 44 are guided such that they extend down the same side of the window cover 10. Accordingly, a user would be able to actuate both first and second panels 14 and 16 by accessing one side of the window. In this embodiment, the first and second cords 42 and 44 may be joined or secured to each other such that they would both be pulled together to open the first and second panels simultaneously.

In an alternative embodiment, the routing of the first and second cords 42 and 44 may be separate such that the first cord 42 controlling the first panel 14 may be on one side of the window 12 and the second cord for controlling the second panel 16 may be on the second side of the window 12.

In the present invention, each of the first and second panels 14 and 16 may be formed of a fabric material which has a continuous and uninterrupted panel surface. When the first and second panels 14 and 16 assume the closed position, the fabric lies substantially flat and smooth. This provides the desirable aesthetic of a roman shade. There is no need for pleats, multiple slates or other complicated structures in order to allow the window covering to move between the open and closed position.

While the retractable window covering 10 of the present invention provides an aesthetically pleasing cover for arched windows, it may also be employed to cover other nonrectangular-shaped windows. For example, with reference to FIG. 6, the present invention is shown applied to a trapezoidal-shaped window. The window covering 70 may be formed in a manner similar to window covering 10 described above; however, the configuration of the frame and first and second panels is modified to accommodate the particular shape of the window. Window covering 70 includes a first panel 72 and second panel 74 which partially overlap when in the closed position. The first and second panels are configured so that they together form the shape of the window when in the closed position.

A portion of the perimeter of the first and second panels is fixedly secured to a frame 78. The frame 78 may include a plurality of linear segments 78*a* which are joined end to end forming a generally arch-shaped perimeter sized to match the perimeter of the window to be covered. The bottom ends 79*b* of the frame may be secured to a linearly extending base 79. The first and second panels 72 are unattached to the base and free to move relative thereto to permit the window to be uncovered.

The first and second panels 72 and 74 may be lifted to an open position by way of a retracting mechanism 80. Retracting mechanism 80 may be formed in a manner similar to the retracting mechanism 40 described above. The retracting mechanism 80 may included first and second cords 82 and 84 which extend through a cord guide 86. The cord guide 86 may include a plurality of spaced hooks 88 and loops 90 fixedly secured to the frame 78 and first and second panels. The first and second cords 82 and 84 are free to travel in a guided manner through the cord guide 86. The first cord 82 may have an end secured to a bottom portion of the first panel 72, and the second cord 84 may have an end secured to a bottom of the second panel 74. A user may open the window covering 70 to expose the window by pulling down on the first and second cords 82 and 84, which lifts the first and second panels toward the frame 78 and away from each other. When the first and second cords 82 and 84 are released, the weight of the first and second panels returns them to the closed position shown in FIG. 6. Weights 92 may be added to the bottom edges of the first and second panels to assist in the closing of the panels.

When in the closed position, the first and second panels 72 and 74 provide a flat interrupted surface for the window covering.

Various changes to the foregoing described and shown structures would now be evident to those skilled in the art. Accordingly, the particularly disclosed scope of the invention is set forth in the following claims.

What is claimed is:

1. A retractable covering for an arched-portion of a window comprising:

a first and a second panel formed of pliable material, the first and second panels each including a first and second generally straight and intersecting sides and a curved side joining the first and second sides, the first and second sides join at a corner and form an obtuse angle, a flap of the first panel overlapping a flap of the second panel, the first and second panels together having generally an arch-shaped upper perimeter adapted to be secured to a support structure and a generally straight lower perimeter; and a retracting mechanism for moving the first and second panels between a closed position wherein the arched window is substantially covered, the first and second panels forming a generally semicircular window covering when in the closed position, and an open position wherein the arched portion of the window is substantially uncovered, the retracting mechanism including a first cord having an end secured to the corner of the first panel, and a second cord having an end secured to the corner of the second panel, the retracting mechanism having a first operating state to position the first and second panels in the open position and a second operating state wherein the first and second panels are positioned in the closed position, the end of the first cord crosses over the end of the second cord and the ends of the first and second cords lying on opposite sides of a center point of the generally straight lower perimeter when the first and second panels are in the closed position, the retracting mechanism further including a cord guide through which at least a portion of the first and second cords extend, the cord guide guiding the first and second cords along the arched perimeter of the first and second panels.

2. The retractable covering as defined in claim 1, wherein the curved sides are securable to a support structure.

3. The retractable covering as defined in claim 1, wherein the first cord is fastened to the first panel at a location proximate to the intersection of the first and second sides.

4. The retractable covering as defined in claim 1, wherein the first cord is slidingly connected to the first panel at spaced locations.

5. The retractable covering as defined in claim 4, wherein the first panel includes a plurality of loops secured thereto and aligned in a generally linear configuration, and the first cord extends though the plurality of loops.

6. The retractable covering as defined in claim 5, wherein movement of the first cord lifts the first flap in a generally straight line radial direction toward the arch-shaped perimeter and away from the second panel.

7. The retractable covering as defined in claim 6, wherein movement of the second cord lifts the second flap in a generally straight line radial direction toward the arch-shaped perimeter and away from the second panel to uncover the window.

8. The retractable covering as defined in claim 1, wherein the first cord extends from the perimeter toward a lower portion of the first panel flap in a generally radial direction.

9. The retractable covering as defined in claim 8, wherein the second cord extends from the perimeter toward a lower portion of the second panel flap in a generally radial direction.

10. The retractable covering as defined in claim 8, wherein the first cord is fixedly secured to the first panel flap at a location proximate to the intersection between the first and second sides.

11. A retractable covering for an arched window comprising:

an arch-shaped support structure adapted to be secured to a window frame;

a first and a second panel formed of pliable material, the first and second panels each including a first and second generally straight and intersecting sides and a curved side joining the first and second sides, the first and second sides join at a corner and form an obtuse angle, a flap of the first panel overlapping a flap of the second panel, the first and second panels together having generally an arch-shaped upper perimeter secured to the support structure and a generally straight lower perimeter, the first and second panels having a closed position wherein the arched window is substantially covered, and having an open position wherein the arched window is substantially uncovered; and a retracting mechanism for moving the first and second panels between the open and closed position, the retracting mechanism including a first cord having an end secured to the corner of the first panel, and a second cord having and end secured to the corner of the second panel, the retracting mechanism having a first operating state to position the first and second panels in the open position and a second operating state wherein the first and second panels are in the closed position wherein the first and second panels form a substantially flat and smooth surface when in the closed position, the end of the first cord crosses over the end of the second cord and the ends of the first and second cords lying on opposite sides of a center point of the generally straight lower perimeter when the first and second panels are in the closed position, the retracting mechanism further including a cord guide through which at least a portion of the first and second cords extend, the cord guide guiding the first and second cords along the arched perimeter of the first and second panels.

12. The retractable covering as defined in claim 11, wherein the cord guide is secured to the frame.

13. The retractable covering as defined in claim 11, wherein the cord guide includes a plurality of spaced supports.

14. The retractable covering as defined in claim 11, wherein the first and second panels form a generally semicircular window covering when in the closed position.

15. The retractable covering as defined in claim 11, wherein the first cord extends from the support in a generally radial direction toward a bottom portion of the first panel, and the second cord extends from the support in a generally radial direction toward a bottom portion of the second panel.

16. The retractable covering as defined in claim 11, wherein the support structure includes an arched frame and the first and second panels are secured thereto.

17. The retractable covering as defined in claim 16, wherein the support structure includes a base.

* * * * *